US009593685B2

(12) United States Patent
Marioni

(10) Patent No.: US 9,593,685 B2
(45) Date of Patent: Mar. 14, 2017

(54) METHOD FOR COLLECTING CONDENSATE INSIDE AN APPARATUS, APPARATUS EQUIPPED WITH A CONDENSATE COLLECTION SYSTEM AND MOTOR-PUMP ASSEMBLY INTENDED FOR A CONDENSATE COLLECTION SYSTEM

(71) Applicant: Askoll Holding S.r.l. a socio unico, Povolaro di Dueville (Vicenza) (IT)

(72) Inventor: Elio Marioni, Dueville (IT)

(73) Assignee: Askoll Holding S.r.l., a socio unico (IT)

( * ) Notice: Subject to any disclaimer, the term of this patent is extended or adjusted under 35 U.S.C. 154(b) by 476 days.

(21) Appl. No.: 14/289,124

(22) Filed: May 28, 2014

(65) Prior Publication Data

US 2014/0352333 A1 Dec. 4, 2014

(30) Foreign Application Priority Data

May 28, 2013 (EP) ..... 13425078
Jan. 29, 2014 (EP) ..... 14425006

(51) Int. Cl.
*F04D 15/02* (2006.01)
*F24F 13/22* (2006.01)
(Continued)

(52) U.S. Cl.
CPC ..... *F04D 15/0218* (2013.01); *D06F 58/24* (2013.01); *F24F 13/222* (2013.01); *D06F 25/00* (2013.01); *D06F 58/28* (2013.01)

(58) Field of Classification Search
CPC ..... F04D 15/0218; F24F 13/22; F24F 13/222; D06F 25/00; D06F 58/24; D06F 58/28; F25D 21/14
(Continued)

(56) References Cited

U.S. PATENT DOCUMENTS 8,028,536 B2 * 10/2011 Morgan ..... B01D 5/009 62/272
2008/0245092 A1 * 10/2008 Forsberg ..... E03B 3/28 62/288

FOREIGN PATENT DOCUMENTS

DE 2933513 A1 3/1981
DE 8912184 U 1/1990
(Continued)

*Primary Examiner* — Marc Norman
(74) *Attorney, Agent, or Firm* — Akerman LLP

(57) ABSTRACT

A method for collecting condensate inside an apparatus, including: providing a condensate collection system with bottom and top collection tanks; a condensate discharge pump to displace liquid from the bottom collection tank to the top collection tank; and an overflow system which displaces the liquid contained in the top collection tank that exceeds an overflow level into the bottom collection tank; collecting a condensed liquid in the bottom collection tank; actuating the condensate discharge pump to displace the condensed liquid from the bottom collection tank into the top collection tank; detecting a low load condition of the condensate discharge pump, actuation of the condensate discharge pump being interrupted upon detection of the low load condition; the actuating time ($T_2$) of the condensate discharge pump, with signalling of a full condition of the condensate collection system when this actuating time ($T_2$) is equal or larger than a maximum time ($T_{2lim}$).

17 Claims, 6 Drawing Sheets

(51) Int. Cl.

| | |
|---|---|
| ***D06F 58/24*** | (2006.01) |
| *D06F 25/00* | (2006.01) |
| *D06F 58/28* | (2006.01) |

(58) Field of Classification Search
USPC ..... 62/150, 280, 285, 291
See application file for complete search history.

(56) References Cited

FOREIGN PATENT DOCUMENTS

| | | | | | |
|---|---|---|---|---|---|
| DE | 102009055194 | A1 | | 6/2011 | |
| EP | 2439840 | A1 | | 4/2012 | |
| GB | 2115127 | A | | 9/1983 | |
| IT | EP 2808548 | A1 | * | 12/2014 | ..... D06F 58/24 |

* cited by examiner

METHOD FOR COLLECTING CONDENSATE INSIDE AN APPARATUS, APPARATUS EQUIPPED WITH A CONDENSATE COLLECTION SYSTEM AND MOTOR-PUMP ASSEMBLY INTENDED FOR A CONDENSATE COLLECTION SYSTEM

CROSS-REFERENCE TO RELATED APPLICATIONS

The present application claims priority to European Patent Application No. 13425078.6, filed May 28, 2013 and European Patent Application No, 14425006.5, filed Jan. 29, 2014, the entirety of which are incorporated herein by reference.

FIELD OF APPLICATION

The present invention relates, in its most general aspect, to a method for collecting condensate inside an apparatus equipped with a condensate collection system, for example a tumble dryer or an air conditioner.

The present invention also relates to an apparatus equipped with a condensate collection system and to a motor-pump assembly specifically intended to operate a condensate collection system inside an apparatus of the above-mentioned type.

As mentioned above, the invention is intended therefore for the sector of laundry washing or washing/drying machines, or for the sector of air conditioners, in particular portable air conditioners equipped with an internal condensate collection system. In more general terms, the invention falls within the technological sector of electric household appliances.

PRIOR ART

Various apparatuses, used in a domestic and/or industrial environment, internally collect condensation water resulting either from a process for conditioning the ambient air, as in the case of portable air conditioners, or from a tumble-drying cycle, as in the case of drying or washing/drying machines.

A condensate collection system 90 which is commonly used in apparatuses 500 of the above-mentioned type is shown in FIG. 2 of the present application. The condensation water resulting from operation of the apparatus 500, for example a portable air conditioner or a tumble dryer, flows due to gravity into a bottom tank 2. The condensation water is then cyclically conveyed, via a suitable condensate discharge pump 50, to a top tank 3 which has a drawer-like configuration and which can easily be emptied by the user.

The condensate discharge pump 50 is typically controlled directly by the main control board 60 of the apparatus 500. Generally, the condensate discharge pump 50 is activated at regular intervals during operation of the apparatus and, whenever activated, is kept in operation for a predetermined time interval sufficient to empty the bottom tank 2.

If the top tank 3, however, cannot be emptied regularly, it may happen that it fills up beyond a threshold level. In such cases, in order to prevent overflowing that could damage the electronic components of the apparatus 500, an overflow system 4 is provided so that any excess liquid is returned to the bottom tank 2.

In order to prevent the bottom tank 2 from overflowing, which is less critical but still undesirable, a float-type level sensor 5 is also housed inside the bottom tank. When a threshold level is reached, the float sensor forwards a signal to the main control board 60 which in turn stops the apparatus 500 and signals the full condition to the user.

The system described above, although substantially satisfying the requirements of the sector, nevertheless has a number of drawbacks mainly associated with the presence of the float sensor.

This float sensor in fact generates additional costs with regard to manufacture of the apparatus, said costs being due both to the component itself and to the need to connect it to the main control board via a specific cabling.

Another drawback arises from the possibility of jamming or incorrect operation of the float sensor, which, as well as giving rise to extraordinary maintenance costs, may also result in lack of signalling of the full condition with consequent overflowing of the collected condensation water.

A further drawback arises from the strict operational protocol for activation of the condensate discharge pump, which involves a very long set activation time even when the amount of condensate collected inside the bottom tank is minimal or even non-existent. This results in energy consumption which could to a large extent be avoided.

The technical problem forming the basis of the present invention is therefore that of devising a method for collecting the condensate inside an apparatus which overcomes the drawbacks of the previously identified prior art and which in particular avoids the need to use a float-type level sensor in order to detect filling of the collection system.

SUMMARY OF THE INVENTION

The aforementioned technical problem is solved by a method for collecting the condensate inside an apparatus, said method comprising the following steps:

- providing a condensate collection system comprising: a bottom collection tank and a top collection tank; a condensate discharge pump intended to displace liquid from the bottom collection tank to the top collection tank; and an overflow system which causes displacement of the liquid contained in the top collection tank and exceeding an overflow level into the bottom collection tank;
- collecting a condensed liquid during operation of said apparatus in the bottom collection tank;
- actuating said condensate discharge pump so as to displace said condensed liquid from the bottom collection tank into the top collection tank;
- at the same time as the step of actuating said condensate discharge pump, detecting a low load condition of said condensate discharge pump, actuation of the condensate discharge pump being interrupted upon detection of said low load condition;
- at the same time as the step of actuating said condensate discharge pump, performing a measurement of the actuating time of the condensate discharge pump, with signalling of a full condition of the condensate collection system when this actuating time is equal or larger than a maximum time.

As a person skilled in the art can appreciate, the method outlined above uses a method for detecting the load of the condensate discharge pump which allows operation thereof to be interrupted when the low load indicates that the bottom collection tank is empty.

Owing to this detection, it is easy to determine the full condition of the condensate collection system without having to use the float-type level sensor used in the prior art. In fact, in the event of the collection system being completely full, continuous recirculation of the condensed liquid between the bottom tank and top tank takes places, and the low load conditions which determine switching-off of the condensate discharge pump are never reached. This results in the duty cycle of the pump being indefinitely prolonged, this being detected by the system electronics and generating a suitable diagnostic signal.

Signalling of a full condition of the condensate collection system preferably causes the apparatus to be halted.

The low load condition, depending on implementation of the method, may correspond to operation of the condensate discharge pump under no load or operation of the condensate discharge pump in air/water conditions.

In particular, said step of detecting the low load condition of the condensate discharge pump may be directly performed by a local control board installed on the condensate discharge pump itself, preferably without the use of sensors.

For example, the condensate discharge pump may be actuated by a permanent-magnet, synchronous, electric motor, preferably of the mono-phase type, said step of actuating said condensate discharge pump comprising a step of driving said electric motor by means of phase regulation control so as to obtain in feedback a condition of minimum phase shift between current supplying the windings of the electric motor and generated counter-electromotive force, said step of detecting a low load condition of the condensate discharge pump involving the verification of the firing angle applied during phase regulation control, where said low load condition is indicated by a maximum firing angle being reached or exceeded.

The method for automatic detection of the electric pump load, which is particularly advantageous in connection with the present invention, is disclosed in patent application EP 2 439 840 in the name of the same applicant.

This step of performing a measurement of the actuating time of the condensate discharge pump may also be carried out by the local control board; in that case, the entire control architecture of the condensate collection system is advantageously integrated in the condensate discharge pump.

Alternatively, the step of performing a measurement of the actuating time of the condensate discharge pump may be carried out by a main control board of the apparatus also intended to control other electronic devices installed in the apparatus.

The actuating state of the condensate discharge pump may be determined without using sensors, for example by means of a two logic state current measurement along the circuit section which supplies the electric motor of the condensate collection pump.

In this case the advantage of not having to provide a signal cable between the local control board and the main control board of the apparatus is obtained.

In the method according to the present invention, said step of actuating said condensate discharge pump may be performed cyclically during operation of the apparatus, for example at regular intervals, where preferably these intervals correspond to the estimated time for filling of the bottom collection tank during operation of the apparatus.

The maximum actuating time of the condensate discharge pump defined above is preferably equal to or greater than the actuating time of the condensate discharge pump needed to empty completely the bottom discharge tank in the fully filled condition.

In the method proposed above, the detection of the low load condition of the condensate collection pump is particularly critical. It must be preferably performed without using sensors so as to avoid an excessive cost of the device, and at the same time ensure precision and reliability such as to allow efficient implementation of the said method.

As mentioned above, in an embodiment of the present invention the detection is performed by means of a threshold check of the instantaneous firing angle used during phase-control driving of the synchronous motor which rotationally operates the pump.

However, the threshold which defines an effective low load condition is variable depending on at least three different parameters, in particular:

- the grid power supply voltage;
- the quantity of liquid still present in the collection tank; and finally
- the length of the pipe which connects the condensate discharge pump to the top collection tank.

The effect of the first parameter can be partly compensated for by adopting a variable threshold, depending on the instantaneous grid voltage; this however increases the computational complexity of the control system.

The effect of the second parameter cannot be compensated for unless a level sensor is incorporated again, but this cancels out the advantages obtained by the method introduced.

The last parameter, finally, requires dedicated calibration of the motor control board with respect to the dimensions of the specific condensate collection system.

In practice, it has been found that the variability of the aforementioned parameters does not allow a precise distinction between the full load and the low load condition, therefore preventing this information from being used to switch off the pump beforehand.

In order to allow an efficient implementation of the condensate collection method proposed in the present invention, the following method for detecting a low load condition of a pump actuated by a synchronous electric motor—which is alternative to the simple threshold check proposed above—has also been devised by the Applicant.

The method comprises the following steps:

steady-state driving of said electric motor by means of phase-cutting control, a feedback setpoint thereof being a condition of minimum phase-shift between current supplying the windings of the electric motor and generated counter-electromotive force;

detecting at least two firing angles successively applied, in relation to said phase-cutting control, during two successive half-periods of a voltage supplying the electric motor;

calculating at least one variation between two consecutive firing angles previously detected;

comparing said variation, or the sum of said successive variations, with a threshold value, where reaching or exceeding said threshold value identifies said low load condition.

This threshold value is preferably predefined and may indicate operation of the pump under no load or operation of the pump in air/water conditions.

The alternative method is therefore no longer based on the concept of exceeding a limit firing angle, but on the difference in this angle between two successive half-periods, thus resolving the problems associated with the variability of the limit threshold of the firing angle.

The steps of detecting the firing angles and calculating the corresponding variations may be repeated continuously for a measurement period (of between 5 s and 15 s for example) at the end of which the comparison between the sum of the variations calculated during the course of said measurement period and the threshold value is performed.

The aforementioned electric motor is preferably a permanent-magnet, single-phase, synchronous electric motor.

Although the aforementioned method may be applied to pumps of another type, it is mainly intended for a condensate discharge pump.

The aforementioned technical problem is also solved by an apparatus equipped with a condensate collection system comprising:

a bottom collection tank intended to collect the condensed liquid during operation of said apparatus; a top collection tank; a condensate discharge pump intended to displace liquid from the bottom collection tank to the top collection tank; and an overflow system which causes displacement into the bottom collection tank of the liquid contained in the top collection tank that exceeds an overflow level;

said apparatus comprising electronic control devices intended to:

actuate said condensate discharge pump so as to displace said condensed liquid from the bottom collection tank into the top collection tank;

detect, during actuation of the condensate discharge pump, a low load condition of said condensate discharge pump and interrupt actuation of the condensate discharge pump upon detection of said low load condition;

perform, during actuation of the condensate discharge pump, a measurement of the actuating time of the condensate discharge pump, and signal, a full condition of the condensate collection system when this actuating time is equal or larger than a maximum time.

The aforementioned technical problem is also solved by a motor-pump assembly comprising a condensate discharge pump, a permanent-magnet single-phase synchronous electric motor intended for actuation thereof, and a local control board intended to drive said electric motor and to:

detect, during actuation of the condensate discharge pump, a low load condition of said condensate discharge pump and interrupt actuation of the condensate discharge pump upon detection of said low load condition;

perform, during actuation of the condensate discharge pump, a measurement of the actuating time of the condensate discharge pump, and signal an anomalous condition when this actuating time is equal or larger than a maximum time.

Said local control board may also be intended to: detect, during operation of the pump, a low load condition of said condensate discharge pump by means of one of the two alternative methods described above.

Further characteristic features and advantages of the present invention will emerge from the following description of two preferred embodiments, provided by way of a non-limiting examples, with reference to the accompanying drawings.

DETAILED DESCRIPTION

Figure 1:
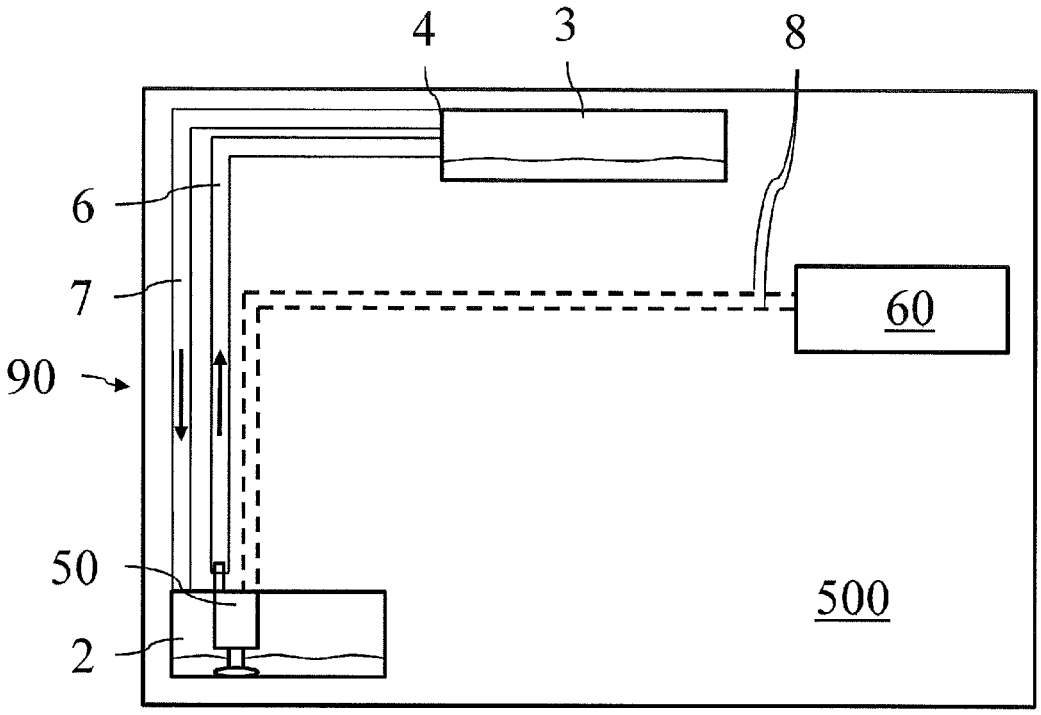
FIG. 1 shows in schematic form an apparatus provided with a condensate collection system according to the present invention.
Figure 2:
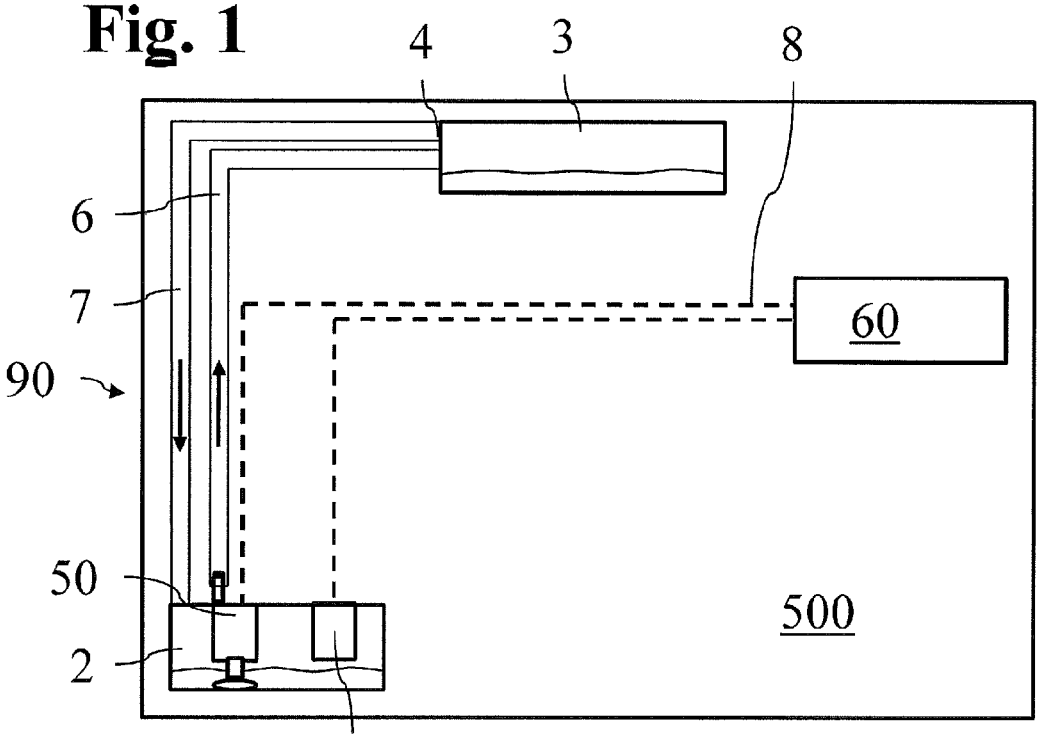
Fig. 2 PRIOR ART
FIG. 2 shows in schematic form an apparatus equipped with a condensate collection system according to the prior art.

With reference to FIG. 1, 500 identifies a generic apparatus provided internally with a condensate collection system 90.

As mentioned above, the apparatus 500 may take the form of various devices which are different from each other in terms of type and function, but which have the common feature that they need to collect a condensation liquid resulting from the more or less continuous operation thereof.

By way of example, in the present detailed description reference will be made to the apparatus 500 in the form of a laundry drying machine; it is understood, however, that a collection system 90 with similar operating modes may be applied to other apparatuses for domestic and/or industrial use, such as a portable air conditioner.

The condensate collection system 90 of the laundry drying machine 500 has, in a known manner, a bottom collection tank 2 and a top collection tank 3 which are in fluid communication with each other.

The bottom collection tank 2 is arranged at the bottom of the laundry drying machine, underneath a heat exchanger. Inside the exchanger, the steam coming from the laundry drum is cooled and converted into condensation water that gradually fills the underlying bottom collection tank 2.

A condensate discharge pump 50 is provided in order to convey the accumulated condensed liquid from the bottom of said bottom collection tank 2 to the top collection tank 3 via a delivery tube 6.

The top collection tank 3, which is preferably arranged on the same level as the control panel of the laundry drying machine 500, is intended so that it can easily be emptied by the operator; for example it may be in the form of as an extractable drawer.

Also to be noted is the presence of an overflow system 4 which returns, via a return tube 7, the condensation liquid exceeding a threshold level from the top collection tank 3 to the bottom collection tank 2. This overflow system 4 may be defined by a spillway formed in the top collection tank 3; when the condensation liquid reaches the spillway, it returns into the bottom collection tank 2 via the return pipe 7 by means of simple gravitational action.

The condensate discharge pump 50, of the known type, is actuated by means of an electric motor 1 which, in the case in question, takes the form of a permanent-magnet single-phase synchronous motor.

An electronic device 20, which is preferably in the form of a local control board, is associated with the electric motor 1 and is intended to drive it by means of phase control or cutting.

The condensate discharge pump 50, the electric motor 1 and the local control board 20 are incorporated in a motor-pump assembly that can be handled separately, of the type described in patent application EP 2 439 840 filed in the name of the same applicant.

Figure 4:
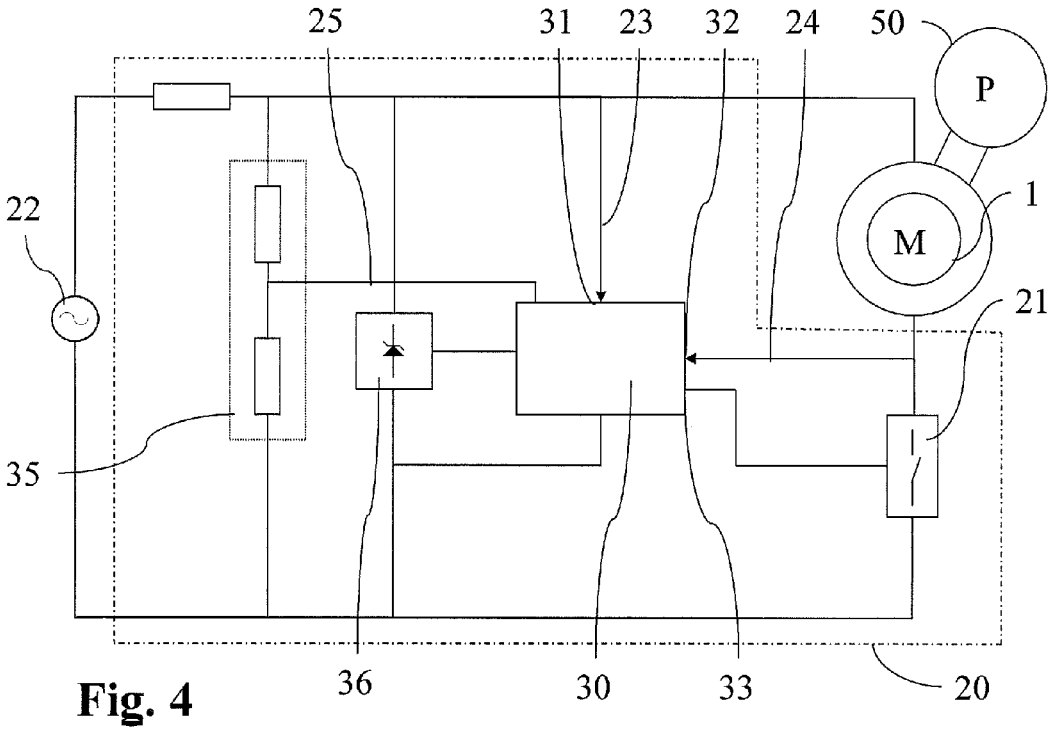
FIG. 4 shows in schematic form a local control board integrated in a motor-pump assembly according to the present invention.

The local control board 20, which may be seen in detail in FIG. 4, comprises a static switch 21, in this specific case a TRIAC switch, intended to cut the current supplied by an AC electrical grid 22 and directed to the windings supplying power to the electric motor 1.

The TRIAC switch 21 is connected to a PWM output 33 of a processing unit 30, which preferably takes the form of a microprocessor.

The local control board 20 has a portion for synchronisation with the grid 35 which sends to the processing unit 30 a grid synchronisation signal 25, i.e. a signal having a unitary value when the voltage of the power supply has positive values, and a zero value when the latter has negative values; the timer for controlling the PWM output 33 is advantageously synchronised with the grid synchronising signal.

Moreover, the local control board 20 has a power supply portion 36 of the processing unit 30, also intended to supply said unit with a voltage reference signal.

The processing unit 30 has a first input 31, which receives a grid voltage signal 23, and a second input 32, which instead receives a voltage signal across the switch 24.

By processing these signals, the processing unit 30 is able to carry out an indirect measurement of the counter-electromotive force generated by the synchronous motor 1, obtained as the difference between the grid voltage signal 23 and the voltage signal on the switch 24, at the moments when the current is zero. The processing unit 30 detects said zero current condition by again by evaluating the voltage signal across the switch 24, and in particular by ensuring that this signal differs sufficiently from the zero value.

In addition to the local control board 20 described above, the laundry drying machine 500 comprises a main control board 60 intended to control all the electronic functions of the machine.

This main control board 60 is arranged in a front top position corresponding to the control panel of the laundry drying machine 500, i.e. it is situated at a distance from the motor-pump assembly which is instead located in the vicinity of the bottom collection tank 2.

The main control board 60 is connected by means of suitable cabling 8 to the local control board 30 of the motor-pump assembly. The cabling may comprise, in addition to the pump power supply wiring, also one or more signal cables; these cables are, however, not strictly necessary, as will become clear from the following description.

Figure 3:
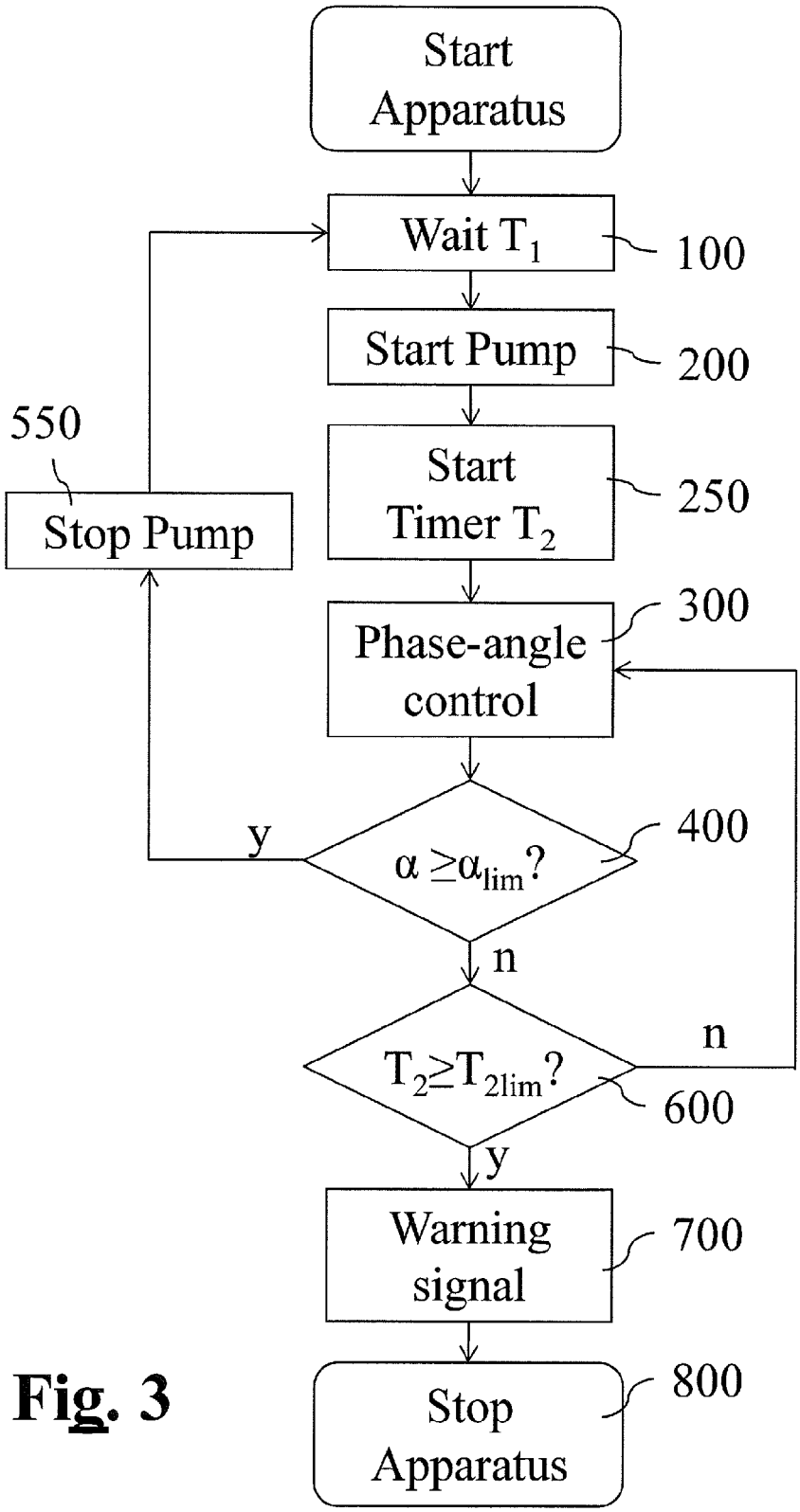
FIG. 3 shows a block diagram which summarizes the various steps of the method according to the present invention.

With reference to the attached FIG. 3, a method of operation, according to a first embodiment of the present invention, of the condensate collection system described above is now described.

This method preferably envisages a cyclical actuation of the condensate discharge pump 50 during operation of the laundry-drying machine 500. Then a waiting step 100 is involves to allow a wait time $T_1$ to elapse between one actuating operation of the condensate discharge pump 50 and the next. This wait time $T_1$ is determined on the basis of the estimated filling time for the bottom collection tank 2.

It should be noted that cyclical actuation of the condensate discharge pump 50 is not necessarily envisaged for the entire period of operation of the laundry drying machine, but concerns only a number of operating cycles during which condensation is produced inside the machine.

In the example embodiment described here, the wait time $T_1$ may be between 100 s and 160 s.

Once said wait time has elapsed, the method according to the present invention includes a start-up step (step 200 in FIG. 3) of the electric motor 1, which actuates the condensate discharge pump 50.

This start-up step is preferably performed in the manner described in patent application EP 2,439,840 and is briefly described below.

The start-up step comprises four successive sub-steps: alignment, waiting, starting, transition towards steady-state operation.

The alignment sub-step is intended to bring the rotor of the electric motor 1 into a predefined starting position.

In order to achieve this result, the processing unit 30 controls the TRIAC switch 21 so as to supply the power supply windings of the motor with a series of current pulses generated only during a given half-period, which is positive or negative depending on the selected starting position, of the voltage signal of the electrical grid 22. In terms of application, the TRIAC switch must therefore be switched on only when the grid synchronising signal 23 assumes a positive value (or negative value depending on the selected half-period).

The subsequent waiting sub-step is intended to allow damping of any oscillations of the rotor of the electric motor 1. At the end of the waiting step, it is thus certain that the rotor has stopped in the predefined starting position.

The subsequent starting sub-step is intended to ensure the actual starting of the electric motor 1.

For this purpose, the processing unit 30 generates a series of current pulses of increasing intensity (adjusted by varying the firing angle $\alpha$ during phase control), these pulses being generated this time in the half-period of the voltage signal of the electrical grid 22 opposite to that of the pulses of the alignment step.

When the signal of the counter-electromotive force exceeds a predetermined control threshold, the last sub-step of transition towards steady-state operation begins.

If, on the other hand, the control threshold for the counter-electromotive force is not reached by the end of the series, the implemented control method carries out the initial start-up sub-steps again.

The last sub-step is intended to drive the motor until the synchronism speed is reached.

In this last sub-step, the processing unit 30 controls the motor according to a specific firing logic which tends to keep the TRIAC switch 21 conducting only when the transit of current in the power supply windings of the electric motor 1 determines a drive torque in the direction of rotation of the rotor.

In particular, the TRIAC switch 21 is switched on when both of the following conditions occur:

a) the estimated signal of the counter-electromotive force must have the same sign as the grid voltage;

b) the estimated signal of the counter-electromotive force must be moving away from zero.

Once the synchronism condition of the synchronous electric motor 1 has been reached, start-up is complete.

Such a condition is assessed by means of a measurement of the phase shift between phase current and voltage. If this phase shift remains more or less constant for a given number of consecutive periods, the synchronism condition is considered to have been reached. If the synchronism condition is not reached within a predefined time period, the method carries out the start-up step again from the beginning.

After the start-up step described above, the method envisages a step of driving the synchronous electric motor 1 at steady state by means of phase control, i.e. by varying the firing angle $\alpha$ which determines the delay in switching on of the TRIAC switch with respect to the change of sign of the grid voltage.

Phase control is gradually introduced, keeping the conditions a) and b) upon switching-on of the switch 21 applied in the aforementioned transition sub-step.

During this driving step, which is indicated by 300 in FIG. 3, the firing angle $\alpha$ is feedback-controlled in order to optimise the energy performance of the electric motor 1.

More specifically, the feedback control is performed by identifying the ideal operating condition of the motor as being one in which the counter-electromotive force passes through zero at a mid-point 80*a* of the zero current plateau 80 set by closing of the TRIAC switch 21. Obviously, the extension of the zero current plateau 80 and the relative position of its mid-point 80*a* depend on the value of the firing angle $\alpha$ used for each current half-period.

The sought-after condition corresponds to zeroing of the phase shift between the current supplying the windings and the generated counter-electromotive force of the synchronous motor 1, a condition that, as is known, ensures that the energy efficiency of the synchronous motor itself is optimised (disregarding the core losses).

Owing to the signal of counter-electromotive force it processes in the manner described above, the processing unit 30 is able to evaluate how the behaviour of the motor differs from the ideal operating condition, consequently correcting in feedback the firing angle $\alpha$ of the TRIAC switch 21.

Figure 5:
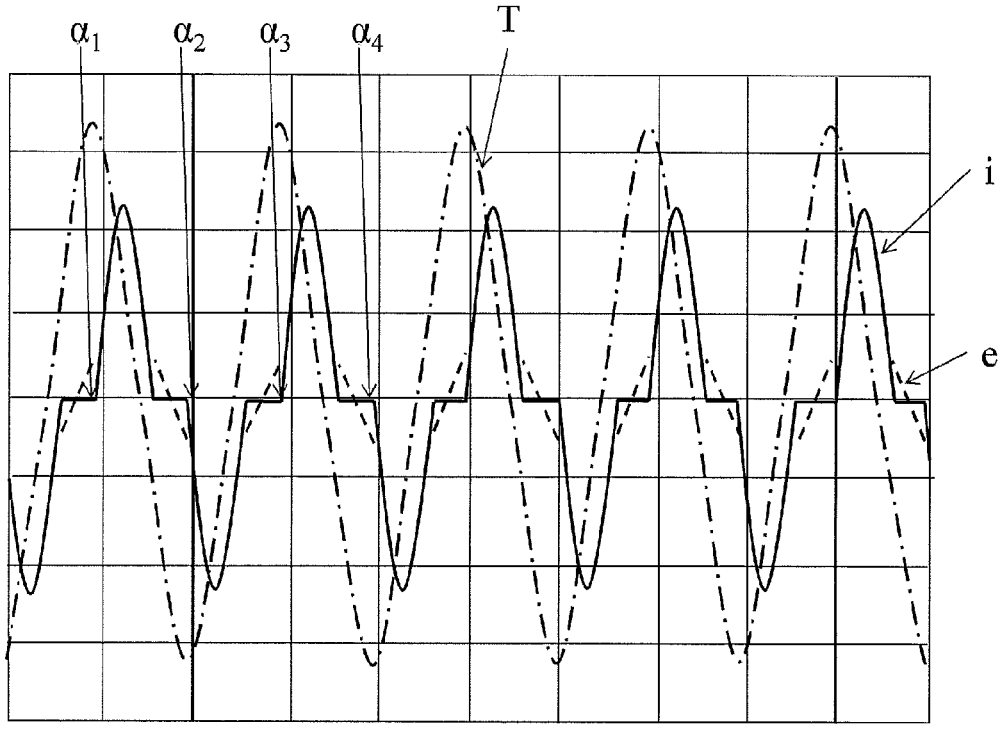
FIG. 5 shows the time progression of a number of parameters relating to the motor-pump assembly according to FIG. 4 during a step of the method shown in FIG. 3

FIG. 5 illustrates the temporal progression of the counter-electromotive force e of the grid voltage T and the stator current i during steady-state operation of the synchronous motor 1; the firing angles used in the first half-periods are indicated by the Greek letter a followed by progressively increasing subscripts.

During steady-state driving, the method according to the present invention continuously checks that the synchronous motor 1 has not reached a low load condition which indicates emptying of the bottom collection tank 2 (check step 400 in FIG. 3).

When the bottom collection tank 2 no longer contains condensation liquid or contains a minimum amount thereof, the condensate discharge pump 50 operates under no load or in air-water conditions, with a consequent reduction in load compared to full flow conditions.

In such conditions, the decrease in load causes a great increase in the need to cut the current in the feedback control algorithm. Thus the method verifies in each half-period that the firing angle $\alpha$ required by the feedback control does not exceed a maximum firing angle value $\alpha_{lim}$, indicative of operation of the pump in air-water conditions, or even of no-load operation, depending on the maximum value chosen.

Advantageously, given that the required cutting also depends on the grid voltage, said maximum threshold $\alpha_{lim}$ may be obtained as a linear function of the grid voltage itself, according to a formula $$\alpha_{lim}=k\cdot V_{grid}+c$$

where k and V are preset parameters.

When the aforementioned verification detects operation in low load conditions, the bottom collection tank 2 is considered to be empty and actuation of the condensate discharge pump 50, or the electronic device 20, interrupts the supply of power to the windings of the synchronous motor 1 (step 550 in FIG. 3).

The temporal variable that measures the wait time $T_1$ between one actuating operation of the condensate discharge pump 50 and the next is then reset and the method is cyclically repeated starting from the aforementioned wait step (step 100 in FIG. 3).

Again during steady-state operation, the method according to the present invention checks in real time that the condensate collection system 90 has not reached a completely full condition.

In order to perform this check, the method comprises a further check step (check step 600 in FIG. 3) in which it checks whether the actuating time $T_2$ of the condensate discharge pump 50 has not reached or exceeded a maximum time $T_{2lim}$, indicatively equal to or greater than the time needed for a complete emptying of the bottom collection tank 2.

An excessive duration of the actuating time $T_2$ is in fact an indication of the complete filling of the top collection tank 3. In this condition, the condensed liquid introduced by the condensate discharge pump 50 is immediately evacuated by means of the overflow system 4 and thus reintroduced into the bottom collection tank 2. The action of the pump therefore causes continuous recirculation of the condensation liquid, such that the partial load condition which should cause it to switch-off never occurs and the pump remains switched on indefinitely. Therefore the measured actuating time $T_2$ rapidly exceeds the maximum time $T_{2lim}$ which, in conditions where the condensate collection system 90 is partly filled, should instead ensure that the bottom collection tank 3 is emptied.

The timer intended to measure the actuating time $T_2$ may be activated at the start of the start-up step or when the condition of synchronism of the motor is reached. This step is indicated by step 250 in FIG. 3.

In the example embodiment described here, the maximum time $T_{2max}$ may be between 10 s and 26 s.

In case the check step described above identifies an actuating time $T_2$ greater than the maximum time $T_{2max}$, a diagnostic signal is generated, indicating the fully filled condition of the condensate collection system 90 (step 700 in FIG. 3), causing for example an indicator lamp to light up on the control panel of the laundry drying machine 500.

Moreover, in order to prevent the bottom collection tank 2 from overflowing, operation of the laundry drying machine 500 is interrupted (step 800 in FIG. 3).

It should be noted that the step of checking the actuating time $T_2$ of the condensate discharge pump 50 may be performed directly by the local control board 20 installed on the motor-pump unit or alternatively by the main control board 500 of the laundry-drying machine 500.

In the first variation of embodiment it is necessary to provide a signal cable to send a diagnostic signal regarding the fully filled condition of the condensate collection system 90 from the local control board 20, which detects the fault, to the main control board 60, which interrupts operation of the laundry drying machine 500 and activates any warning signals or lights.

In the second variation of embodiment, the activation time of the condensate discharge pump 50 is directly monitored by the main control board 60 which is able to detect the operating state of the electric motor 1 by performing a two logic state current measurement along the relevant circuit section. In this embodiment a signal cable between the local control board 20 and the main control board 60 is not required.

Figure 6:
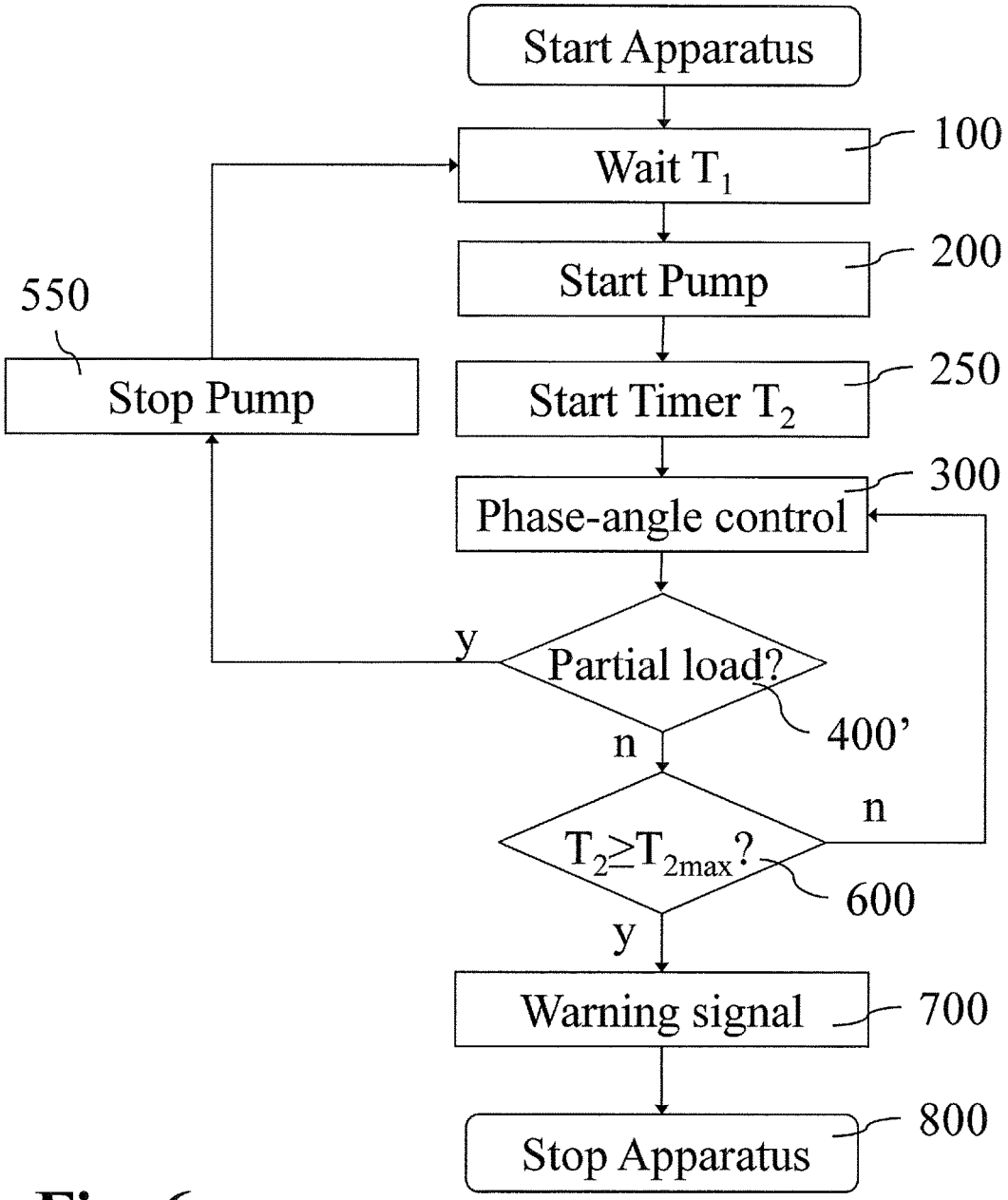
FIG. 6 shows a block diagram which summarizes the various steps of a method according to a second embodiment of the present invention.
Figure 7:
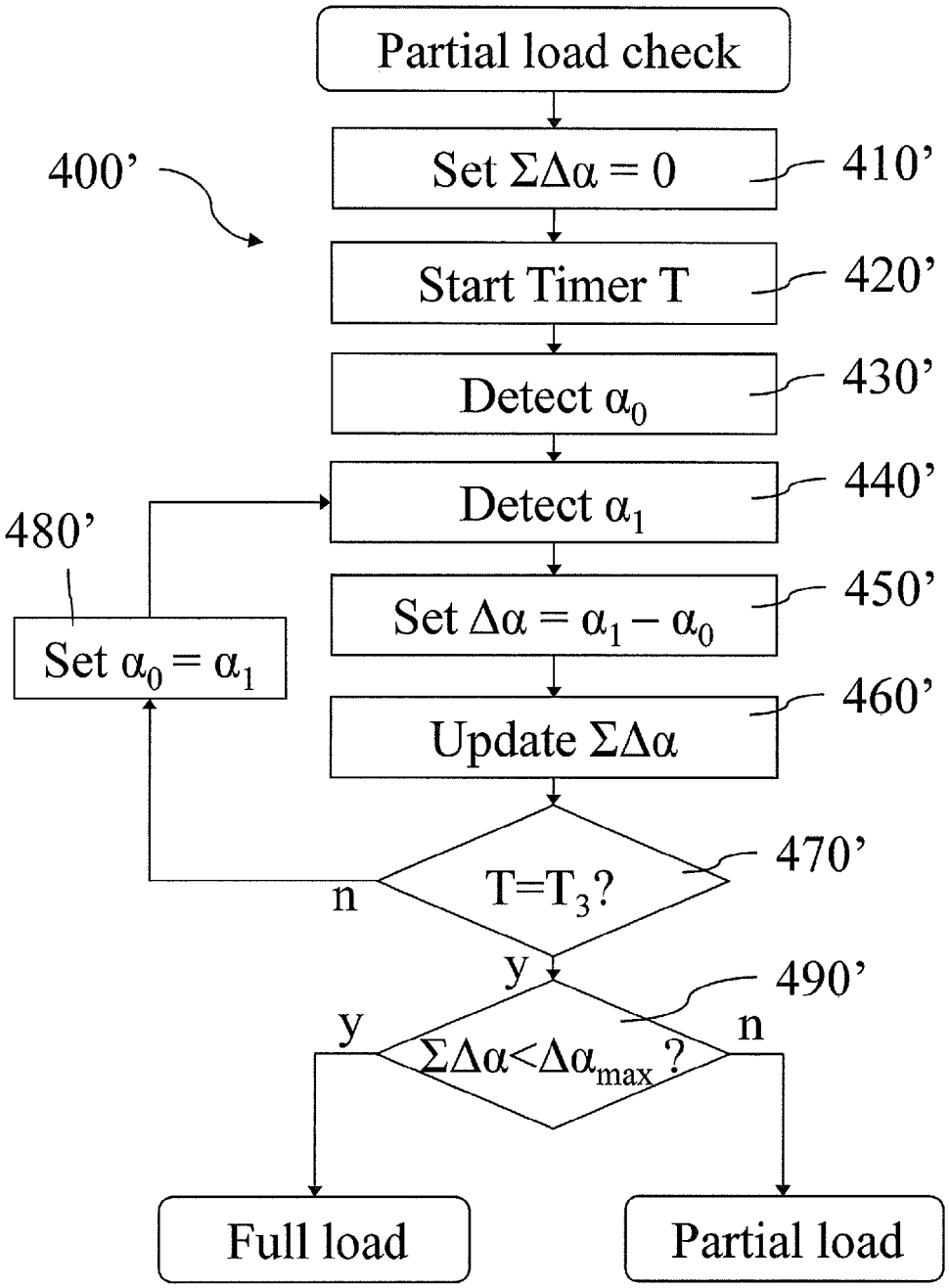
FIG. 7 shows a block diagram which summarizes the various steps of a method for detecting the low load conditions of a synchronous electric pump within the method shown in FIG. 6.

With reference to the attached FIGS. 6 and 7, a method of operation, according to a second embodiment of the present invention, of the condensate collection system described above is now described.

As may be easily inferred by comparing FIGS. 3 and 6, the second embodiment differs from the first embodiment only in that an alternative method for detecting a partial load condition is applied (compare check step 400 in FIG. 3 and check step 400' in FIG. 6). Said alternative sub-method 400' for detecting a partial load condition is depicted in detail in FIG. 7.

During steady-state driving, the method checks that the synchronous motor 1 has not reached a low load condition which indicates emptying of the bottom collection tank 2.

When the bottom collection tank 2 no longer contains condensation liquid or contains a minimum amount thereof, the condensate discharge pump 50 operates under zero load or in air/water conditions, with a consequent reduction in load compared to full flow operating conditions.

In such conditions, the decrease in load causes a great increase in the need to cut the current in the feedback control algorithm and therefore a great discontinuity in the firing angle $\alpha$ compared to the limited oscillations of this value which occur in full load conditions.

Precisely on the basis of the variations of the firing angle $\alpha$ during the subsequent half-periods of the supply voltage T, the sub-method according to the second embodiment defines the low load conditions of the condensate discharge pump 50.

During a first step 410' of this sub-method, a variable $\Sigma\Delta\alpha$ which identifies the sum of the variations in the firing angle $\alpha$ during the successive half-periods is initialized.

Then, a second step 420' is provided for initialising a timer intended to measure a preset measurement time $T_3$ which in the embodiment described here is equal to 10 s.

This is followed by execution of the steps 430', 440' for acquiring a first firing angle $\alpha_0$ and a successive firing angle $\alpha_1$ for two consecutive half-periods.

On the basis of these measurements, a step 450' for calculating a variation $\Delta\alpha$ of the firing angle during the last half-period is performed; during a following step 460' this variation is incorporated in the calculation of the sum of the variations $\Sigma\Delta\alpha$.

If the entire measurement time $T_3$ has not yet elapsed (check step 470'), an updating step 480' is carried out where the value of the last firing angle detected replaces the penultimate value and then the following firing angle is reacquired and the calculation of the variation is repeated, updating the sum $\Sigma\Delta\alpha$.

Once the measurement time $T_3$ has lapsed, a check step 490' is carried out to compare the resultant value of the sum $\Delta\alpha_{max}$ with that of a preset threshold value $\Delta\alpha_{max}$ which identifies the low load operation of the pump.

If the sum $\Sigma\Delta\alpha$ remains below said threshold value $\Delta\alpha_{max}$, full load operation of the condensate discharge pump 50 is established; vice versa, a same or higher value indicates operation of the pump in air/water conditions, or even operation under zero load, depending on the threshold value $\Delta\alpha_{max}$ adopted.

Preferably the aforementioned measurement time $T_3$ is selected from among the submultiples of the aforementioned maximum actuating time $T_{2lim}$. When the aforementioned sub-method detects operation in low load conditions, the bottom collection tank 2 is considered to be empty and actuation of the condensate discharge pump 50, or the electronic device 20, interrupts the supply of power to the windings of the synchronous motor 1, just as in the operation according to the first embodiment (step 550 in FIG. 6).

The methods and devices described above offer a series of advantages which are listed below.

A first advantage consists in the elimination of the float level sensor present in the prior art, with a corresponding reduction in the production and maintenance costs and greater reliability of the system which is no longer subject to malfunctioning of such a sensor.

A second advantage consists in the fact that the method for collecting condensate described above results in operation which is optimised from an energy point of view and is relatively silent, operation of the condensate discharge pump being interrupted as soon as the bottom collection tank is emptied.

Another advantage, relating to the variation of embodiment where checking the activation time is performed by the local control board, consists in the integration of all of the condensate collection system control functions in the motor-pump assembly.

Another advantage, relating to the variation of embodiment where checking the activation time is performed by the main control board, consists in the elimination of any signal cable between the main control board and the bottom collection tank.

Another advantage, relating to the alternative method for detecting the low load condition of the pump applied in the second embodiment, consists in having a reliable and consistent detection of the low load condition even though the operating conditions of the apparatus are variable.

Obviously, a person skilled in the art, in order to satisfy any specific requirements which arise, may make numerous modifications and variations to the method and device described above, all of which however fall within the scope of protection of the invention, as defined by the following claims.

The invention claimed is:

1. A method for collecting the condensate inside an apparatus, said method comprising the following steps:

providing a condensate collection system comprising: a bottom collection tank and a top collection tank; a condensate discharge pump intended to displace liquid from the bottom collection tank to the top collection tank; and an overflow system which causes displacement of the liquid that is contained in the top collection tank and that exceeds an overflow level into the bottom collection tank;

collecting a condensed liquid during operation of said apparatus in the bottom collection tank;

actuating said condensate discharge pump in order to displace said condensed liquid from the bottom collection tank into the top collection tank;

said method comprising the further steps of:

at the same time as the step of actuating said condensate discharge pump, detecting a low load condition of said condensate discharge pump, actuation of the condensate discharge pump being interrupted upon detection of said low load condition;

at the same time as the step of actuating said condensate discharge pump, performing a measurement of the actuating time of the condensate discharge pump, with signalling of a full condition of the condensate collection system when this actuating time is equal or larger than a maximum time.

2. The method according to claim 1, wherein said low load condition corresponds to operation of the condensate discharge pump under no load.

3. The method according to claim 1, wherein said low load condition corresponds to operation of the condensate discharge pump in air-water conditions.

4. The method according to claim 1, wherein said step of detecting a low load condition of the condensate discharge pump is performed by a local control board which is installed on the condensate discharge pump itself.

5. The method according to claim 4, wherein said step of performing a measurement of the actuating time of the condensate discharge pump is also performed by the local control board.

6. The method according to claim 4, wherein said step of performing a measurement of the actuating time of the condensate discharge pump is carried out by a main control board of the apparatus also intended to control other electronic devices in the apparatus.

7. The method according to claim 6, wherein, in order to perform a measurement of the actuating time of the condensate discharge pump, the actuating state of the condensate discharge pump is determined by means of a two logic state current measurement.

8. The method according to claim 1, wherein said step of detecting a low load condition of the pump is a sensorless step.

9. The method according to claim 1, wherein said condensate discharge pump is actuated by a permanent-magnet synchronous electric motor, said step of actuating said condensate discharge pump comprising a step of driving said electric motor by means of phase regulation control so as to obtain in feedback a condition of minimum phase-shift between current supplying the windings of the electric motor and generated counter-electromotive force, said step of detecting a low load condition of the condensate discharge pump involving verification of the firing angle applied during phase regulation control, where said low load condition is indicated by a maximum firing angle being exceeded.

10. The method according to claim 9, wherein said electric motor is a permanent-magnet single-phase synchronous electric motor.

11. The method according to claim 1, wherein said step of actuating said condensate discharge pump is performed cyclically during operation of the apparatus.

12. The method according to claim 1, wherein said maximum actuating time is equal to or greater than the actuating time of the condensate discharge pump needed to completely empty the bottom discharge tank in the fully filled condition.

13. The method according to claim 1, wherein signalling of a full condition of the condensate collection system preferably produces halting of the apparatus.

14. The method according to claim 1, wherein said a pump is actuated by a synchronous electric motor, further comprising the step of:

steady-state driving of said electric motor by means of phase-cutting control, a feedback setpoint thereof being a condition of minimum phase-shift between current supplying the windings of the electric motor and generated counter-electromotive force;

said step of detecting a low load condition of the condensate discharge pump being performed according to the following steps:

detecting at least two firing angles successively applied, in relation to said phase-cutting control, during two successive half-periods of a voltage supplying the electric motor;

calculating at least one variation between two consecutive firing angles previously detected;

comparing said variation, or the sum of said successive variations, with a threshold value, where reaching or exceeding said threshold value identifies said low load condition.

15. The method according to claim 14, wherein the steps of detecting the firing angles and calculating the corresponding variations are repeated continuously for a measurement period at the end of which the comparison between the sum of the variations calculated during the course of said measurement period and the threshold value is performed.

16. An apparatus equipped with a condensate collection system comprising:

a bottom collection tank intended to collect the condensed liquid during operation of said apparatus; a top collection tank; a condensate discharge pump intended to displace liquid from the bottom collection tank to the top collection tank; and an overflow system that causes displacement of the liquid that is contained by the top collection tank and that exceeds an overflow level into the bottom collection tank;

said apparatus comprising electronic control devices intended to actuate said condensate discharge pump so as to displace said condensed liquid from the bottom collection tank into the top collection tank;

said electronic control devices being also intended to:

detect, during actuation of the condensate discharge pump, a low load condition of said condensate discharge pump and interrupt actuation of the condensate discharge pump upon detection of said low load condition;

perform, during actuation of the condensate discharge pump, a measurement of the actuating time of the condensate discharge pump and signal a full condition of the condensate collection system when this actuating time is equal or larger than a maximum time.

17. A motor-pump assembly comprising a condensate discharge pump, a permanent-magnet single-phase synchronous electric motor intended for actuation thereof, and a local control board intended to drive said electric motor, said local control board being also intended to:

detect, during actuation of the condensate discharge pump, a low load condition of said condensate discharge pump and interrupt actuation of the condensate discharge pump upon detection of said low load condition;

perform, during actuation of the condensate discharge pump, a measurement of the actuating time of the condensate discharge pump and signal an anomalous condition when this actuating time is equal or larger than a maximum time.

* * * * *